United States Patent [19]

Pruzan

[11] Patent Number: 4,716,863

[45] Date of Patent: Jan. 5, 1988

[54] INTERNAL COMBUSTION ENGINE VALVE ACTUATION SYSTEM

[76] Inventor: Daniel A. Pruzan, 845A Taughannock Blvd., Ithaca, N.Y. 14850

[21] Appl. No.: 798,465

[22] Filed: Nov. 15, 1985

[51] Int. Cl.[4] ..... F01L 1/34

[52] U.S. Cl. ..... 123/90.15; 123/90.12

[58] Field of Search ..... 123/90.12, 90.13, 90.15, 123/90.16

[56] References Cited

U.S. PATENT DOCUMENTS

| | | | |
|---|---|---|---|
| 2,615,438 | 10/1952 | Tucker | 123/90.15 |
| 2,962,013 | 11/1960 | Reggio | 123/90.15 |
| 3,727,595 | 4/1973 | Links | 123/90.12 |
| 3,865,088 | 2/1975 | Links | 123/90.12 |
| 4,111,165 | 9/1978 | Aoyama et al. | 123/90.15 |
| 4,153,016 | 5/1979 | Hausknecht | 123/90.15 |
| 4,231,543 | 11/1980 | Turner et al. | 123/90.15 |
| 4,244,553 | 1/1981 | Esrobosa | 123/90.15 |
| 4,484,546 | 11/1984 | Burandt | 123/90.15 |

FOREIGN PATENT DOCUMENTS

| | | | |
|---|---|---|---|
| WO85/01984 | 5/1985 | PCT Int'l Appl. | 123/90.15 |

*Primary Examiner*—Ira S. Lazarus

*Attorney, Agent, or Firm*—Pascal & Associates

[57] ABSTRACT

A hydraulically controlled valve train system for improving performance and emission characteristics of internal combustion engines over a wide range of speed and load. A master hydraulic cylinder containing a master piston replaces the valve lifter in a conventional engine and bears against the camshaft of the engine. A slave cylinder hydraulically coupled to the master cylinder has a slave piston coupled to open an intake valve of the engine. A control cylinder is also hydraulically coupled to the hydraulic line and increases the closed volume of the hydraulic line with increasing pressure in the hydraulic line caused by forced displacement of the master piston by rotation of the camshaft. A solenoid under control of a microcomputer dynamically varies the limit of movement of the control piston, and thus of expansion of the hydraulic line volume, thereby controlling the opening and closing, timing and displacement of the intake valve. External control of the microprocessor affords complete control over the operation of the engine, eliminating the requirement for a throttled carburetor. Since the camshaft and intake valve structures of a conventional engine are maintained, the hydraulic valve actuating system can be produced for conventional engines with minimal tooling cost.

3 Claims, 9 Drawing Figures

INTERNAL COMBUSTION ENGINE VALVE ACTUATION SYSTEM

This invention relates to a valve actuation system for use in an internal combustion engine, and particularly to a system for dynamically varying the timing of intake valves of the engine.

BACKGROUND OF THE INVENTION

The performance and emission characteristics of an internal combustion engine largely depend on the timing of the valve events, i.e., the effective opening area for fluid flow and duration. The variation of the timing by even several engine crank angle degrees significantly affects the engine performance and emission characteristics. In production engines the valve operating pattern is set at the factory and cannot be varied by the engine operator. The determination of the valve opening distance (lift) and its timing is made by taking into account various factors, e.g., performance, engine operation speed, emission and design limits. Due to the recent demand for better engine operation, advanced control technology is being applied to many of the engine systems, including the fuel/air preparation system as a function of exhaust oxygen content, engine speed, intake manifold vacuum, etc. This control is presently being performed by employing microprocessors. Control of engine systems may be greatly enhanced by the additional control of the valve events.

Even without considering the wide use of variable valve timing (VVT) in production engines, it is highly desirable to make VVT available during the engine development stage so that the search for an optimum valve train can be facilitated. Engineers can use the VVT to find the camshaft pattern that meets the design criteria without resorting to the trial and error approach to reach the goal.

Among the other areas of VVT application is automobile racing where wide ranges of engine speeds are encountered. Since for each engine speed there is an optimum set of valve operating conditions, an engine equipped with a VVT device could be controlled to run at its peak efficiency throughout its entire operating range. This may enable the engine operator to reduce the number of gear changes presently required.

The area in which the VVT would have a great impact is in the enhancement of passenger car performance and emissions. A car equipped with a VVT engine can be operated at high efficiency in a wide range of engine speeds and loads. The VVT is expected to enable the engine operator to cause the same automobile to be operated with great economy and to achieve high performance by a simple shift of a VVT control unit. It has been found that such a design could lower specific fuel consumption, lower cylinder gas temperatures, increase the turbulence intensity and burning speed of the combustion gases, and reduce the NOx production of the engine.

The control of the effective valve opening pattern may be achieved by varying the closing position and the net lift of the engine's intake valve. This is the prime objective of the VVT device. In today's conventional engines, the intake valve generally opens at about 20 to 30 degrees before top dead center and closes at about 75 degrees after bottom dead center, and opens to a maximum lift of about 0.375 to 0.425 inches. As previously noted, the operating characteristics of the camshaft remain constant over the entire driving condition. Because of the fixed timing of valve events with respect to engine crank angle, conventional engines must employ a throttled carburetor to attain variable power output. Inherent in carburetor throttling is some degree of pumping loss. Pumping loss is the combination of work necessary to overcome both the frictional losses due to air flowing around the throttle plates, and the P-V work encountered when the cylinder volume increases at subatmospheric pressures.

The VVT engine eliminates the use of the throttle plate in its carburetor. Instead, the engine load control is accomplished by varying the closing position of the intake valve. This may be called intake valve throttling (IVT) since it is achieved by early intake valve closing. With intake valve throttling the fresh charge is inducted through an unrestricted carburetor at near atmospheric pressure by the downward moving piston, and when the correct amount of fuel and air has been introduced into the cylinder, the intake valve closes. Intake valve throttling does not completely eliminate pumping loss but it does cut it down considerably. It has been reported that at intermediate speeds, the pumping loss at full load consumes about 5% of the indicated power, whereas the pumping loss at light load consumes about 50% of the indicated power. FIGS. 1A and 1B are graphs of pressure VS volume for conventional and VVT engines respectively. It may be seen that there is considerably reduced pumping loss (the crosshatched area) in the VVT engine.

FIGS. 2, 3 and 4 are graphs illustrating three different VVT schemes, which plot intake valve lift VS crankshaft position, for intake valve throttling. The valve performance shown in FIG. 3 corresponds to the P-V diagram in FIG. 1B. This method is believed to result in the greatest reduction in pumping loss. Valve performance in FIG. 2 also reduces pumping loss but not quite as much due to the fact that at light loads the engine will incur pumping loss at the beginning of the cycle as well as at the end of the cycle. The valve performance in FIG. 4 gives little reduction in pumping loss since the partially opened valve acts to constrict the flow of fuel and air into the cylinder and thus drops the cylinder pressure below atmospheric throughout the entire intake stroke. It has been shown that at reduced intake valve lift, turbulence intensity is increased, leading to a more complete burning of the fuel-air mixture and thus allowing the idle fuel mixture to be leaned out with minimum misfire and cyclic variations. It has been noted that significant gains in B.S.F.C. (brake specific fuel consumption) are possible near idle engine operation for intake valve throttling when sufficient dilution (leaning) of the mixture is employed to decrease the burnrate to be equivalent to conventional engine burnrate.

In terms of power output and unit cycle, the optimum intake valve closing position is a direct function of engine speed, the faster the engine is running and the later the intake valve should close. This utilizes the inertia of the mixture column in the induction duct, thus offsetting the cylinder pressure. As shown in FIG. 5, which graphs unit air charge VS average piston speed and corresponding camshaft angle VS valve condition, camshaft A is the most efficient in mixture induction at very low speed operation, but it falls off quite rapidly at even moderate speeds. Camshaft C is optimum for mid-range speeds and likewise, camshaft F is appropriate for high speed engine conditions, but none of them are efficient throughout the entire operating range of engine speed. In a successfully controlled VVT engine, the control system, e.g., a microprocessor, should continuously vary the intake valve closing position to achieve maximum cylinder filling at all engine speeds. An engine that is mostly operated in a low speed economy mode can thereby produce more torque for uphill driving. This would allow the car manufacturers to produce their economy cars with even smaller engines or produce an economical car with more top end power and a greater top speed.

In addition to performance improvements, a decrease in the formation of NOx pollutants has been shown in intake valve throttled engines. It has been found that a VVT engine can produce roughly 24% less NOx pollutants at half load operation than a conventionally throttled engine due to the lower cylinder gas temperatures found with early intake valve closing.

For a VVT design to be successful, it most of all must be sturdy and reliable. It must be able to survive a wide range of operating temperatures and it must be able to handle the grease, oil, and fuel found in an engine compartment. It must also be able to withstand prolonged engine vibrations. In addition to these mechanical attributes, it must be able to perform its primary function of varying both valve lift and duration consistently, and it should be capable of microprocessor control.

DESCRIPTION OF THE PRIOR ART

In one prior art VVT system, the camshaft is entirely removed and is replaced by either an electro-mechanical solenoid or a high pressure oil pump and a hydraulic piston (see Automotive Engineering, May 1984, pages 79–81, an article entitled VALVE ACTUATION CONTROLLED BY COMPUTER, by R. M. Richman).

In another prior art system, the camshaft is retained, but uses a mechanical actuator to rotate the camshaft relative to the crankshaft (see Automotive Engineering, May 1984, pages 86–87, an article entitled VARIABLE VALVE TIMING HAS ELECTRONIC CONTROL, by David Scott).

The electro-mechanical solenoid VVT system described above mounts a magnetic solenoid above every valve, thus giving the system the ability to control each valve event separately. The main advantage of this system is its ease and flexibility of valve event control, but the solenoids needed appears to be unproven in terms of reliability and the setup requires a large initial setup cost.

The hydraulic unit that eliminates the camshaft described above consists of a high pressure oil pump, a controlling servovalve fed by the oil pump, a hydraulic actuator operated by the servovalve for opening and closing the engine valve, a valve position transducer, and controlling circuits for controlling the servovalve from a digital computer and from the valve position transducer.

This design appears to be useful for laboratory research where the large size of the components is not a problem and a good supply of high pressure oil is available, but at this time the design appears to have a maximum operating speed of 1000 R.P.M. and thus is not practical for production automobiles.

Another design which is currently in production by the Alfa Romeo sports car company employs a helically cut gear on the nose of the camshaft which advances the camshaft a maximum of 16 degrees relative to the timing chain (32 degrees relative to the crankshaft) while the engine is running. This design is proven to work, but can only be used to advance the intake valve pattern 32 degrees to effect an increase in valve overlap and cannot alter the lift or duration of the valve pattern at all. While this design is an improvement over fixed valve timing, it does not give the variability needed to achieve true VVT optimization.

SUMMARY OF THE INVENTION

The present invention of a hydraulic valve actuation system (HVA) is based on a conventional overhead valve internal combustion engine with the lifter, pushrod, and rocker arm removed. These are replaced by three main components of the HVA system: a master cylinder, a slave cylinder, and a control cylinder.

The master cylinder is fitted into the lifter bore of the engine, and itself contains a lifter in the form of a piston in the cylinder which bears against the camshaft cam associated with a particular intake valve. A slave cylinder is rigidly mounted above an intake valve of the engine, and has a slave piston which bears against the valve for pushing the valve open against the pressure of a valve spring, when extended. A hydraulic line containing hydraulic fluid couples the control and slave cylinders. A structure preferably involving a control cylinder increases the closed volume of the hydraulic line with increasing pressure in the line caused by displacement of the master piston, to dynamically variable controlled limits. With this structure timing of opening and closing and stroke length of the intake valve relative to the stroke of the master piston can be controlled and varied.

Preferably the structure for varying the limits is comprised of a solenoid having a movable core forming a stop. The control cylinder coupled to the hydraulic line has a control piston the position of which causes variation of the displacement in the control cylinder and thus of the closed volume of the hydraulic line. The control piston is preferably coupled to the stop by means of a compression spring. The intake valve of course also has a (compression) closure spring. The force of the intake valve spring should be greater than the force of the compression spring.

When the camshaft pushes the master cylinder piston (lifter) into the master cylinder, the control cylinder is as a result forced first against the stop, following which increasing pressure in the hydraulic line causes the slave piston to push with more force against the valve spring. The valve spring compresses and the intake valve opens. Microcomputer control of the solenoid affords dynamic control of the stop position, and thus of the timing and opening distance of the intake valve. A predetermined intake valve opening timing pattern can be stored in a ROM memory associated with the microprocessor in accordance with the valve pattern shown for example in FIG. 2. Control of the engine is afforded by manual or automatic selection of a stored signal in the ROM of the microcomputer corresponding to one of the timing curves shown in FIG. 2 for controlling the solenoid, by a control signal input to the microcomputer.

More generally, the invention is a valve actuation system for an internal combustion engine comprising apparatus coupled to a cam on the camshaft of the engine for controlling the position of an associated intake valve, and apparatus for dynamically varying the position independently of any other valve in a predetermined manner depending on a selected lift and duration pattern.

BRIEF INTRODUCTION TO THE DRAWINGS

A better understanding of the invention will be obtained by reference to the detailed description to follow of a preferred embodiment, in conjunction with the following drawings, in which:

FIGS. 1A and 1B are graphs of pressure VS volume for a conventional (carburetor) throttling engine and an early intake valve closing engine respectively, FIGS. 2, 3 and 4 are graphs of intake valve lift VS crankshaft position using three different timing and lift schemes, FIG. 5 illustrates graphs of unit air charge VS average piston speed and crankshaft position for various valve events, FIG. 6 is a schematic diagram of a convention overhead valve internal combustion engine, FIG. 7 is a schematic diagram of an internal combustion engine equipped with a hydraulic valve actuation system in accordance with the present invention, and FIG. 8 is a graph of brake specific fuel consumption vs horsepower for conventional, and VVT engines.

DESCRIPTION OF THE PREFERRED EMBODIMENT

Figure 6:
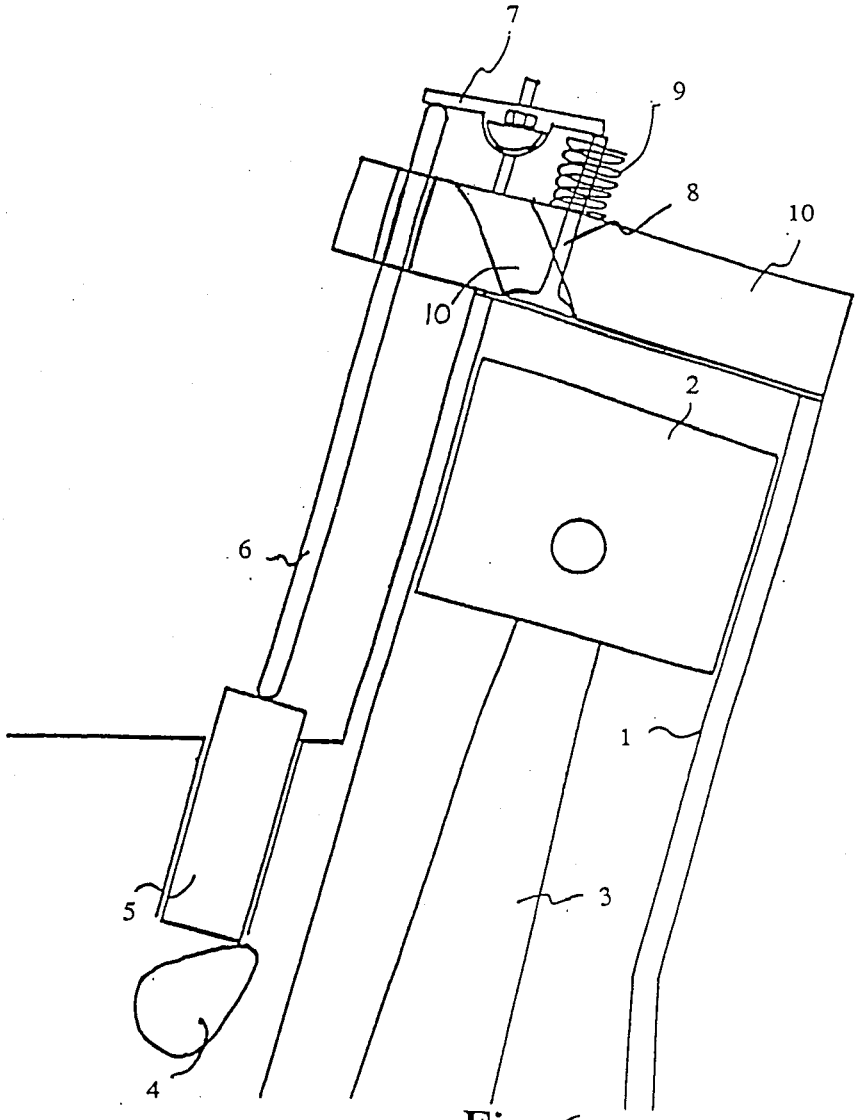
Fig. 6 PRIOR ART

FIGS. 1A, 1B and 2–5 having already been described, reference is now made to a conventional overhead valve internal combustion engine as shown in FIG. 6. The conventional engine consists of a cylinder 1 in which a piston 2 slides, being connected to a main crankshaft (not shown) by a connecting rod 3. A camshaft consisting of a plurality of cams 4 is coupled to the crankshaft (not shown). A valve lifter 5 rides on the cam 4 and reciprocatingly slides within the cylinder block. A pushrod 6 controlled by the lifter bears against a rocker arm 7, the opposite arm of which bears against the top of an intake valve 8. The valve returns to its closed position by means of a valve spring 9. The valve opens and closes an intake port 10 through which a mixture of air and fuel can pass into the cylinder 1 between a cylinder head 10 and the top of the piston 2.

Figure 7:
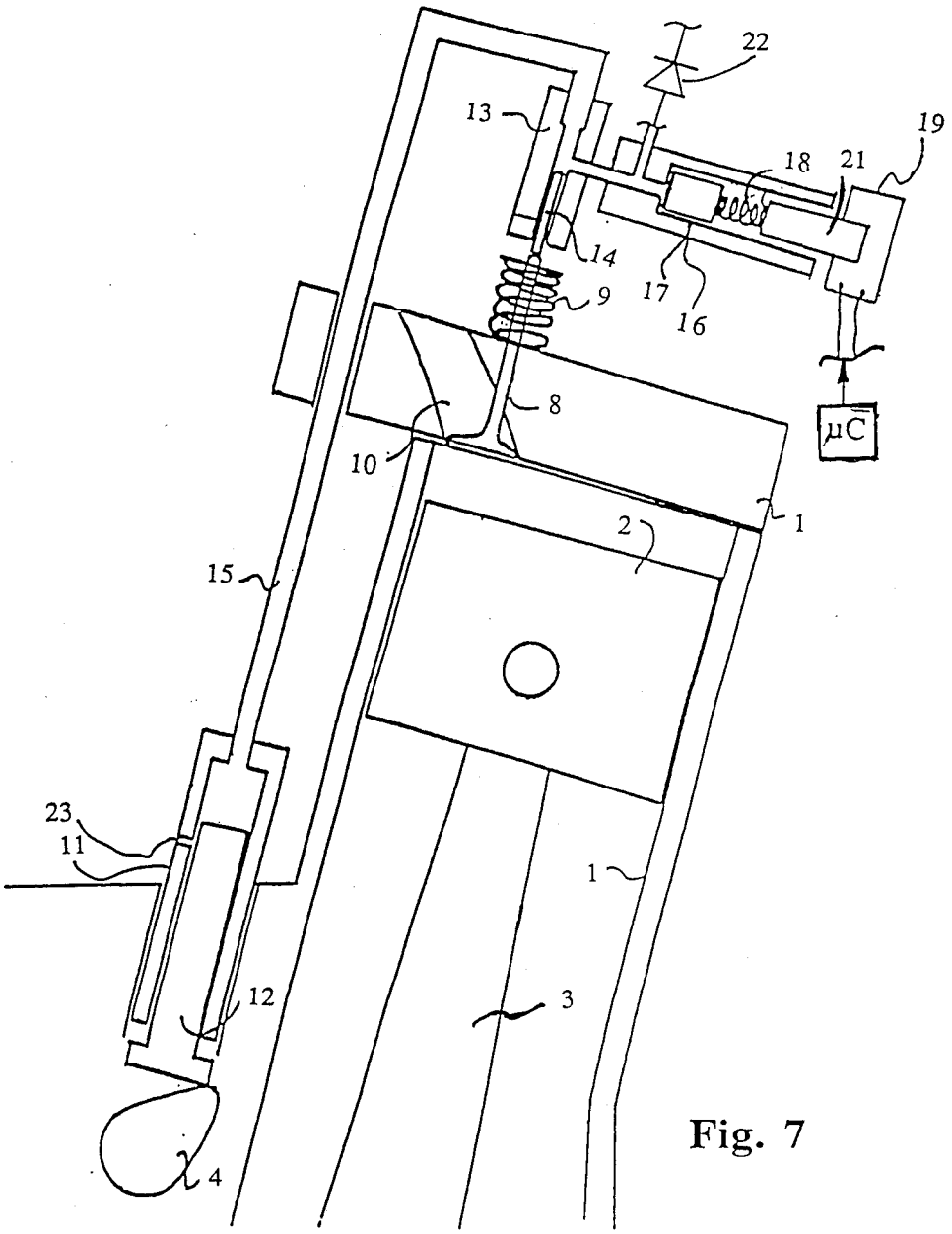

Turning to FIG. 7, the conventional engine with a modified valve actuation system in accordance with the present invention is shown. The lifter 5, pushrod 6 and rocker arm of the conventional engine are removed. A master cylinder 11 is rigidly mounted into the original lifter bore and is fitted with a precision ground hardened steel lifter 12 as a master cylinder piston having e.g., one-half inch diameter. A slave cylinder 3 is rigidly mounted above the intake valve stem and is connected via an oil filled hydraulic line 15 to the master cylinder 11 by means of standard fittings. The slave cylinder is equipped with a precision ground preferably one quarter inch hardened steel dowel pin 14 as a slave piston, which bears against the top of the valve stem. A control cylinder 16 hydraulically coupled to the hydraulic line preferably has a 7/16 inch dowel pin 17 as a control cylinder piston. A 137 lbf/in. control spring 18 bears against a core 21 of a solenoid 19. A front face 21 of a core 20 of solenoid 19 forms a stop. Control spring 18 is contained between the stop and pin 17. The spring 18 must be weaker than the spring 9.

The lifter 12 and two dowel pins 14 and 17 act to seal the high pressure oil line, creating a closed system; thus any volumetric displacement of the lifter 12 must cause responding motion of the two dowel pins. The displacement of the control cylinder dowel pin 17 is limited by the location of the solenoid core 20 which location is controlled by the solenoid 19, and the motion of the slave cylinder dowel pin 14 then corresponds directly to the opening pattern of the valve.

In operation, the camshaft cam 4 rotates around forcing the lifter 12 upwards into the master cylinder 11. At this time the control cylinder pin 17 is forced outwardly of control cylinder 16, which compresses the lighter duty control spring (e.g., 137 lbf/in. versus 500 lbf/in. for the valve spring) until it is fully compressed against the solenoid core 20. The face of the core thus acts as a stop. Thus, the control cylinder has been displaced by an amount depending on the controlled location of the solenoid core.

Only at this time does the slave cylinder dowel pin 14 begin to move, taking up the remainder of the oil displaced by the lifter 12. The farther the control cylinder dowel pin 17 is allowed to move prior to encountering the stop, the less the valve 8 opens, and thus the net valve lift is controlled by the position of the solenoid. If the solenoid is fully extended, preventing the control cylinder dowel pin 17 from moving, the valve 8 will open in the conventional pattern, but as the solenoid is retracted, the valve will open later and close earlier, resulting in the valve event patterns shown in FIG. 2. In fact, if the solenoid is retracted far enough, the entire volume of displaced oil from the master cylinder will be absorbed by the control cylinder 16 and the valve will not open at all, thus preventing powered operation of that cylinder.

A port of a check valve 22 is attached to the hydraulic line side of the control cylinder to continuously recirculate the engine oil in the HVA system. The other port of the check valve is attached to the engine's oiling system which provides typically 40 to 60 psig of fresh oil. The oiling system is open to a spill port 23 in master cylinder 12, which is connected to the high pressure oil line 15. Pressures in oil line 15 typically cycles between zero and 4000 psig. When the lifter 12 is on the base of the camshaft, the oil spill port 23 is uncovered, opening the main oil line 15 to atmospheric pressure, thus allowing the 40 to 60 psig oil to reach the check valve 22 and circulate fresh oil into the system. As soon as the lifter 12 starts to move up, the spill port 23 is covered, the check valve closes and the system is once again sealed, allowing the HVA to operate in the previously described manner.

Control of the valve event patterns with the HVA system can be accomplished by the use of microcomputer controlled electric solenoids. A microcomputer 24 which includes a microprocessor and a ROM memory for storing signals corresponding to the valve timing curves shown in FIG. 2 or FIG. 3 contains a D/A converter and current amplifier which is coupled to drive the solenoid 19. The method of operation of the microcomputer and the circuit for driving the solenoid are known to persons skilled in the art and need not be described in detail. A set of signals forming a curve of FIGS. 2 or 3 are selected by a manual ROM address selection control for controlling operation of the engine.

Figures 1A, 1B, 5:
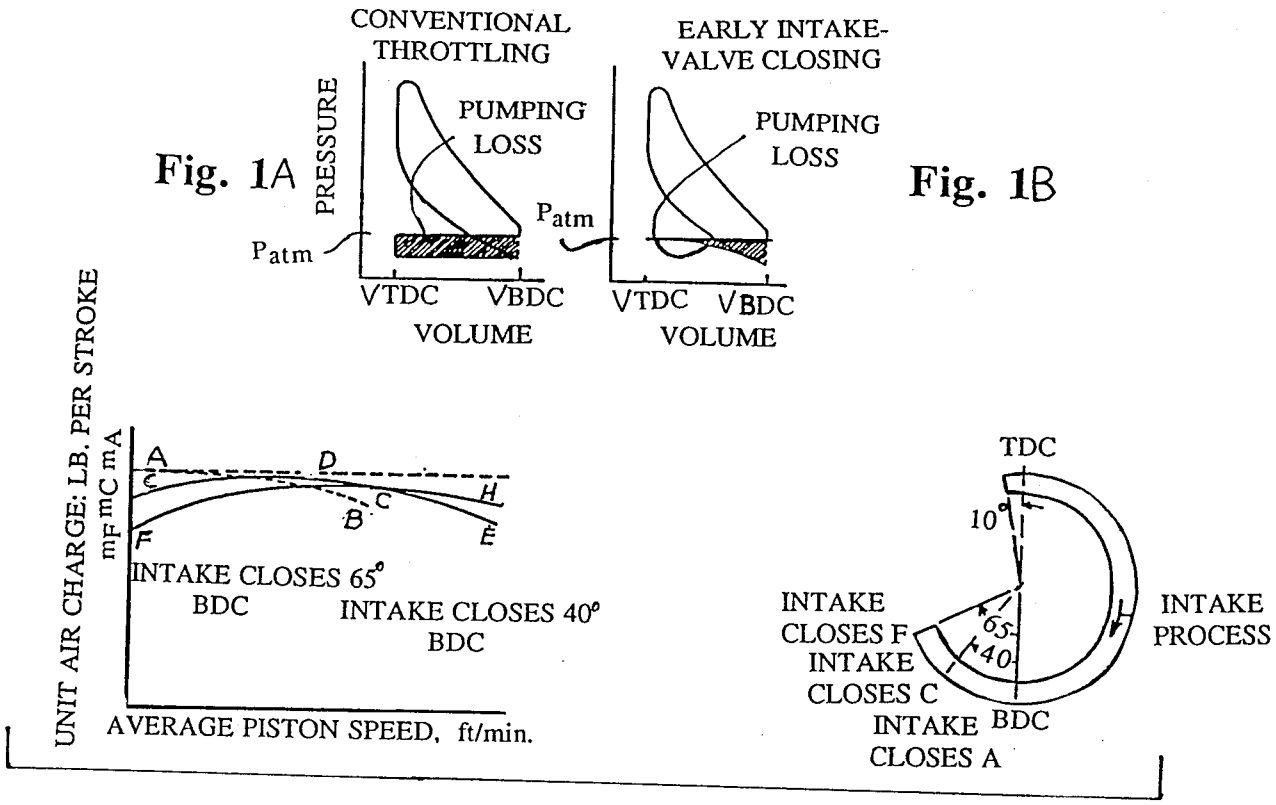
Figure 2:
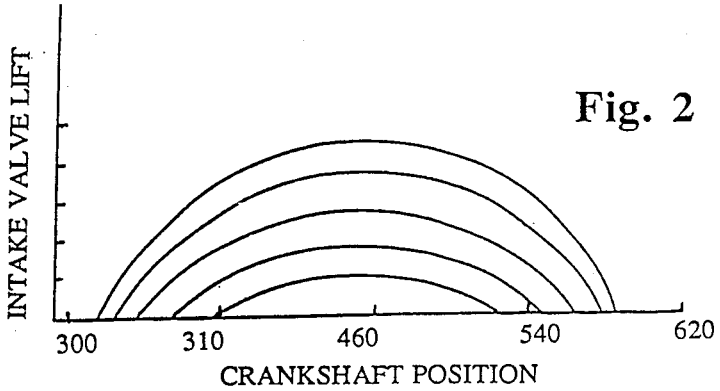

One embodiment, which would result in the valve patterns shown in FIG. 2, is the least complex. The solenoid 19 is set to the desired position corresponding to the appropriate valve lift, and is stationary until a new valve lift is desired. For this mode of operation the solenoid typically requires approximately a two tenths of an inch stroke and does not have to be very fast acting, since most of its operation is at steady state conditions.

Figure 3:
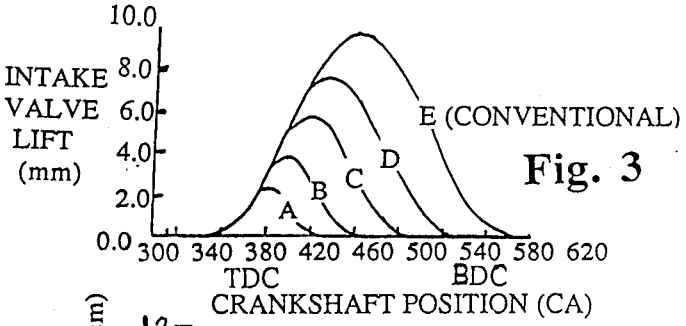
Figure 4:
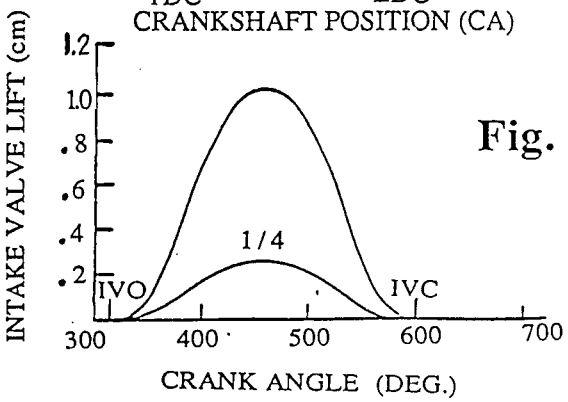

In a second embodiment, the valve patterns shown in FIG. 3 can be achieved, but requires a fast acting solenoid. To achieve these patterns, the solenoid must be fully extended (holding the control cylinder dowel pin 17 stationary) at the beginning of every valve opening cycle. This would initially start the valve opening at the conventional position and the valve opening pattern would start out along the conventional path. To achieve early valve closing, the solenoid must be retracted at the predetermined crankshaft position necessary to obtain the patterns labeled A through D in FIG. 3. The closing rate of the valve in this case is a function of the retraction rate of the solenoid and may be experimentally determined. Since the solenoid must be fully extended at the beginning of every valve opening cycle in this embodiment, the solenoid must operate at a specific frequency corresponding to each specific engine speed. For a normal passenger car engine with a maximum speed of 6000 R.P.M. (notations per minute) rmp (3000 R.P.M. for the camshaft), the solenoid must be capable of a two tenths of an inch stroke with a maximum frequency of 50 cycles per second.

Figure 8:
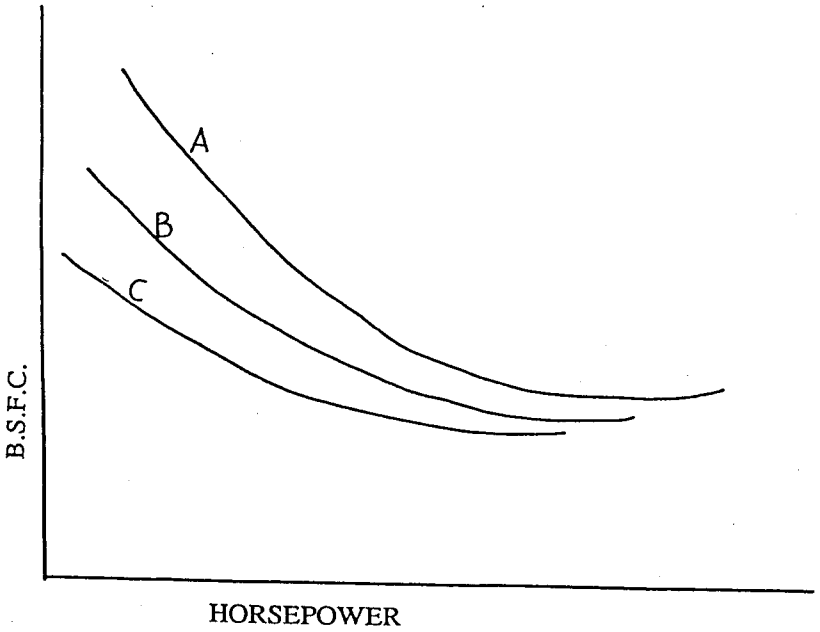

FIG. 8 is a graph of predicted brake specific fuel consumption (BSFC) against horsepower, in which curve A represents a conventional engine using conventional throttling techniques, and curve B represents an engine using part intake valve throttling and part conventional throttling. Pure intake valve throttling is depicted by curve C. Clearly there is a significant improvement in fuel consumption associated with intake valve throttling and the expected reduction in pumping loss and increase in combustion turbulence.

While the description above has been made with reference to a single intake valve actuation system, of course each valve of an engine should have a similar structure. However, a single microprocessor can be used for controlling the solenoids associated with each valve; the digital signal for each solenoid can be latched as the microprocessor sequentially services each solenoid in turn.

The valve actuation system described in this specification has the additional advantage that there is little change to the tooling required for manufacture of the engine, since the conventional camshaft is used as well as the conventional valves. Thus, the system can be readily adapted into production engines.

A person skilled in the art understanding this invention may now conceive of alternative embodiments or variations in the design, which use the principles described herein. All are considered to be within the sphere and scope of the invention as defined in the claims appended hereto.

I claim:

1. A valve actuation system for an internal combustion engine comprising:

(a) means coupled to a cam on the camshaft on the engine for controlling the position of an associated intake valve, (b) means for dynamically varying said position independently of any other valve in a predetermined manner depending on a selectable lift and duration pattern, comprised of a linkage having a variable stroke betwen said cam and said intake valve, the linkage being comprised of a master cylinder containing a master piston coupled as a lifter to said cam, a slave cylinder containing slave piston coupled to said valve for controlling its position, a hydraulic line coupling said cylinders, a control cylinder coupled to the hydraulic line containing a control piston, a stop for the control piston, means for controlling the position of said stop, the position of the control piston being variable up to the stop depending on the retraction position of said master piston, following which the position of the slave piston is varible depending on further retraction of the master piston whereby the displacement of the intake valve is varied with displacement of the master piston, (c) the intake valve including a valve closure spring, (d) a control piston spring which is weaker than the valve closure spring interfacing between the control piston and the stop, and (e) a check valve coupled to the control cylinder for introducing fluid to said hydraulic line, and being coupled to an oiling system of the engine, and an oil spill port in said master cylinder coupled to said oiling system and being uncovered when the master piston is in its fully extended position, whereby fresh oil can be cyclically recirculated from said oil system through the check valve, the hydraulic line and the oil spill port for return to the oiling system.

2. A valve actuation system as defined in claim 1, in which the means for controlling the position of the stop is comprised of a solenoid.

3. A valve actuation system as defined in claim 2, further including a microcomputer in control communication with said solenoid, for storing signals corresponding to predetermined lift and duration patterns for the intake valve, and having a manual power demand control input, coupled to the microcomputer for selecting said patterns for controlling the solenoid.

* * * * *